US006030325A

United States Patent [19]

Ottoson et al.

[11] Patent Number: 6,030,325

[45] Date of Patent: Feb. 29, 2000

[54] THERAPEUTIC DEVICE FOR A HUMAN BODY

[76] Inventors: Bo Ottoson, P.O. Box 111, S-651 04 Karlstad; Ingemar Mählkvist, deceased, late of Eskilstuna; Jan Lindskog, Fristadstorget 3, S-632 20 Eskilstuna, all of Sweden, legal representative

[21] Appl. No.: 08/617,885

[22] PCT Filed: Sep. 19, 1994

[86] PCT No.: PCT/SE94/00865

§ 371 Date: Jun. 16, 1997

§ 102(e) Date: Jun. 16, 1997

[87] PCT Pub. No.: WO95/08307

PCT Pub. Date: Mar. 30, 1995

[30] Foreign Application Priority Data

Sep. 22, 1993 [SE] Sweden ..... 9303117

[51] Int. Cl.[7] ..... A63B 26/00

[52] U.S. Cl. ..... 482/144; 482/145

[58] Field of Search ..... 482/96, 131, 143–145, 482/907, 142, 908; 606/241–245; 602/32–36

[56] References Cited

U.S. PATENT DOCUMENTS

| | | | |
|---|---|---|---|
| 3,570,479 | 3/1971 | Horn | 482/145 |
| 4,002,165 | 1/1977 | Lind . | |
| 4,438,761 | 3/1984 | McGowen . | |
| 4,531,731 | 7/1985 | Law | 482/144 |
| 4,534,555 | 8/1985 | McGowen . | |
| 4,669,724 | 6/1987 | Matheisen | 482/145 |
| 4,717,148 | 1/1988 | Brewer | 482/144 |
| 4,890,604 | 1/1990 | Nelson . | |
| 4,913,424 | 4/1990 | Pepin | 482/145 |
| 5,290,209 | 3/1994 | Wilkinson | 482/142 |
| 5,295,936 | 3/1994 | Perry, Jr. | 482/144 |
| 5,466,205 | 11/1995 | McLane et al. | 482/145 |

FOREIGN PATENT DOCUMENTS

| | | | |
|---|---|---|---|
| 1249848 | 2/1989 | Canada | 482/143 |
| 90087 | 10/1895 | Germany . | |
| 924096 | 1/1955 | Germany . | |
| 1566350 | 12/1970 | Germany . | |
| 2902858 | 1/1980 | Germany | 482/143 |

*Primary Examiner*—Jerome Donnelly
*Attorney, Agent, or Firm*—Watson Cole Grindle Watson, P.L.L.C.

[57] ABSTRACT

Body traction table for treatment of, among other things, back problems that includes a stand presenting a front stand portion (1) and a rear stand portion (2) and supporting a body-supporting table (13) and a footrest (8) which together revolve round a mainly horizontal axis in order to turn the body-supporting table (13) from standard position in which the footrest (8) is lowered into treatment position in which the footrest (8) is above the horizontal axis, the body-supporting table (13) being supported by a frame (5) which is pivotally connected with the stand. At least one of the stand portions (1, 2) is adjustable for height so that the front stand portion (1) can be made shorter or longer than the rear stand portion (2).

5 Claims, 2 Drawing Sheets

THERAPEUTIC DEVICE FOR A HUMAN BODY

BACKGROUND OF THE INVENTION

The present invention relates to a traction table for treatment of, among other things, back problems, and which includes a stand supporting a body-supporting table and a footrest which together revolve around a mainly horizontal axis in order to turn the body-supporting table from standard position in which the footrest is lowered to treatment position in which the footrest is above the horizontal axis. The device, however, is usable for treatment positions in which the footrest is above or below the horizontal axis.

The object of the present invention is to provide a traction table which presents more advantages in relation to the device known from SE-C-455 468.

SUMMARY OF THE INVENTION

The object is achieved with a traction table in which the body-supporting table is supported by a frame which is pivotally connected with the stand of the table and which includes a front stand portion and a rear stand portion. One of the stand portions is adjustable for height whereby the front stand portion can be made shorter or longer than the rear stand portion.

The traction table according to the invention is also characterized in that the locking device known from SE-C-455 468 for gradual adjustment of the body-supporting table into a variety of angles of inclination combined with the stand portions which are adjustable for height can be adjusted, causing the body-supporting table to slope in different angles of inclination in relation to the ground (floor) in addition to the angles of inclination given by the steps in the locking device.

Further details and features of the traction table according to the invention will become evident from the following description taken in conjunction with the accompanying drawings.

DETAILED DESCRIPTION OF THE PREFERRED EMBODIMENTS

Figure 1:
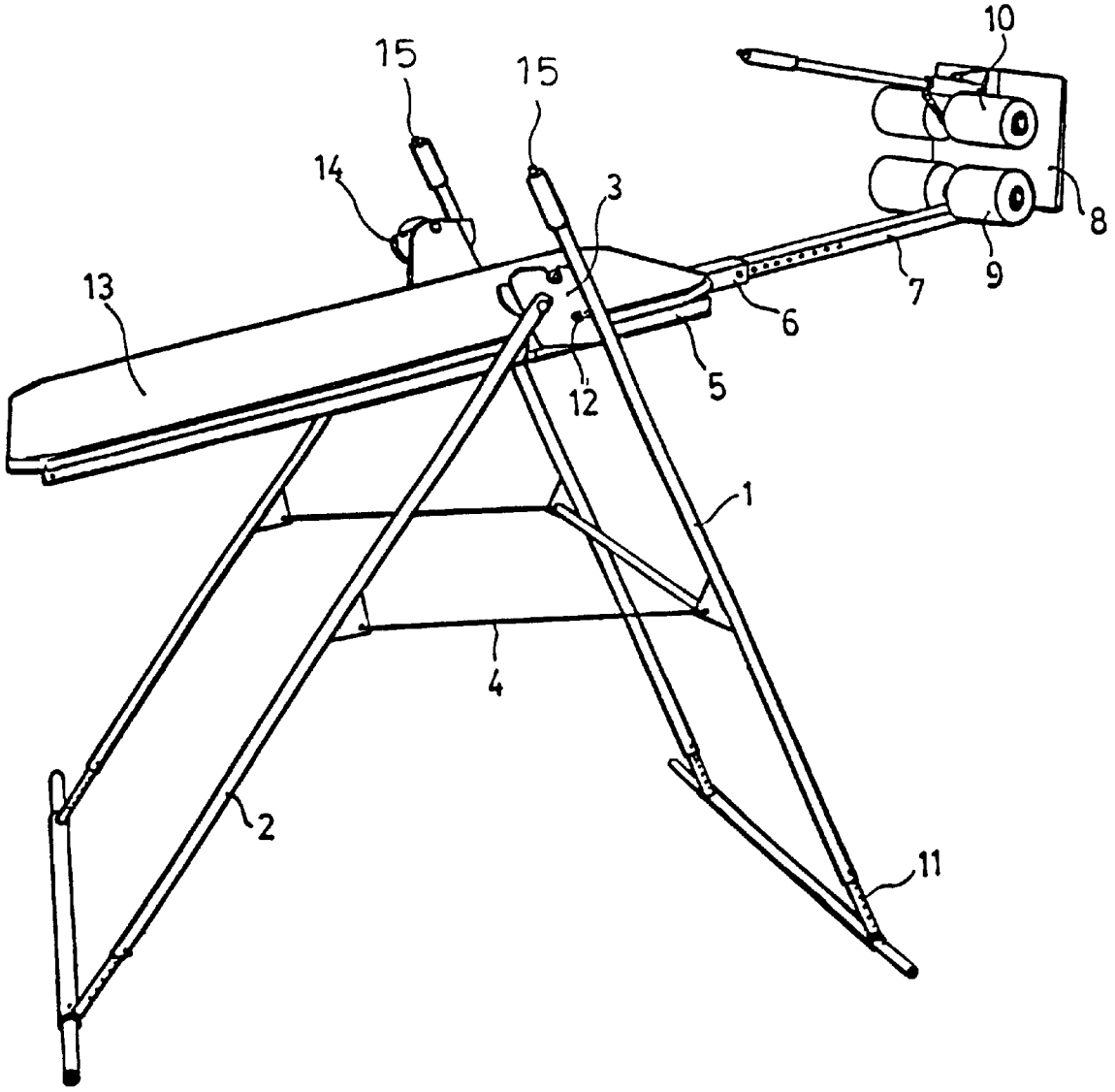
FIG. 1 shows a perspective view of a device according to a first embodiment of the invention.

FIG. 1 shows a device according to the invention which includes a stand consisting of a front stand portion 1 and a rear stand portion 2 which are tubular and connected to each other by means of a mounting plate 3 at each leg of the stand portions 1, 2. The mounting plates 3 are mounted at some distance from the free end sections of the front stand portion 1 whereas the respective free end sections of the rear stand portion 2 are pivotally mounted in the mounting plates 3. In the middle of the legs of the two portions 1, 2, restriction wires or chains 4 are attached which connect the stand portions 1, 2 to each other and prevent them from separating more than allowed by the restriction members. In that way, in side view the stand mainly is formed as an A. Each stand portion 1, 2 shows a connecting transverse foot section 11 which is telescoping within the stand and adjustable by means of pins or screws which are placed into apertures within each leg of the stand.

Pivotally mounted onto the mounting plate 3 is a mainly rectangular frame 5 which on one short side includes a bracket 6 for a bar 7 supporting a footrest 8. On this footrest 8 a fixed rear foot support 9 as well as a front adjustable fixing member 10 are arranged by means of which members the feet of a person to be treated can be fastened to the foot plate 8 The bar 7 supporting the footrest 8 should be provided with a number of adjustment-apertures by means of which the bar can be adjusted into different positions in relation to the bracket 6 by means of a pin which can be passed through the apertures in the bar so that the footrest 8 can be adjusted into different positions for adjustment to the body length of the person to be treated.

The frame 5 is pivoted at the mounting plates 3 and supports in turn a body-supporting table 13 which supports the main part of the body of the person under treatment. In order to limit the revolving of the frame 5 as well as the body-supporting table 13 around each point of suspension in the mounting plates 3, a locking device is employed that includes a semicircular toothed locking rim 14 which is mounted to frame 5 at the mounting plate 3. The locking device includes also a locking pin 12 which can work into notches in the locking rim 14 by moving in radial direction in relation to the locking rim 14. The notches are preferably arranged in steps of 15°. The locking pin 12 is stiffly connected with a control 15 by means of which the locking pin 12 can be displaced in radial direction out of the notches in the locking rim 14. The locking pin 12 is spring-loaded normally to be compressed into a notch in the locking rim 14.

When using the device the stand portions 1, 2 are lowered to the position shown in FIG. 1 and with the body-supporting table 13 being mainly in vertical position and the footrest 8 being at the ground (floor). The person who is going to use the device loosens the foot fixing member 10 and climbs up on to the footrest 8 and then fastens the foot fixing member 10 so that his/her ankles are locked between the foot fixing member 10 and the foot support 9. Initially, the footrest 8 is adjusted by means of the bar 7 to a level where the upper body part of the person standing on the footrest will extend high enough on the body-supporting table 13 so that the body-supporting table, when the person is reclining, will revolve around the mainly horizontal axis around which the body-supporting table 13, by means of the frame 5, is pivotally mounted in the mounting plates 3 of the stand. When the person is reclining against the body-supporting table and loosens the locking device by pressing the control 15 the body-supporting table with the frame revolves into about the position shown in FIG. 1, in which position the locking pin 12 works into the first notch in the locking rim 14.

The body-supporting table according to the invention is covered with a plastic cloth or PTFE-plastic, as it is called, which is for sale under the trademark Teflon and which shows a very low friction towards the body of the person under treatment. The body of the person is drawn downwards and stretched by that, which results in the intended traction. By another pressing of the control 15 the locking pin 12 is moved from the first notch in the locking rim 14 and the body-supporting table 13 with the frame 5 is revolved further until the locking pin works into the next notch in the locking rim. In this way the inclination of the body-supporting table can be adjusted step by step into different positions until the person is lying mainly vertically with the head downwards while the traction is increasing successively.

Figure 2:
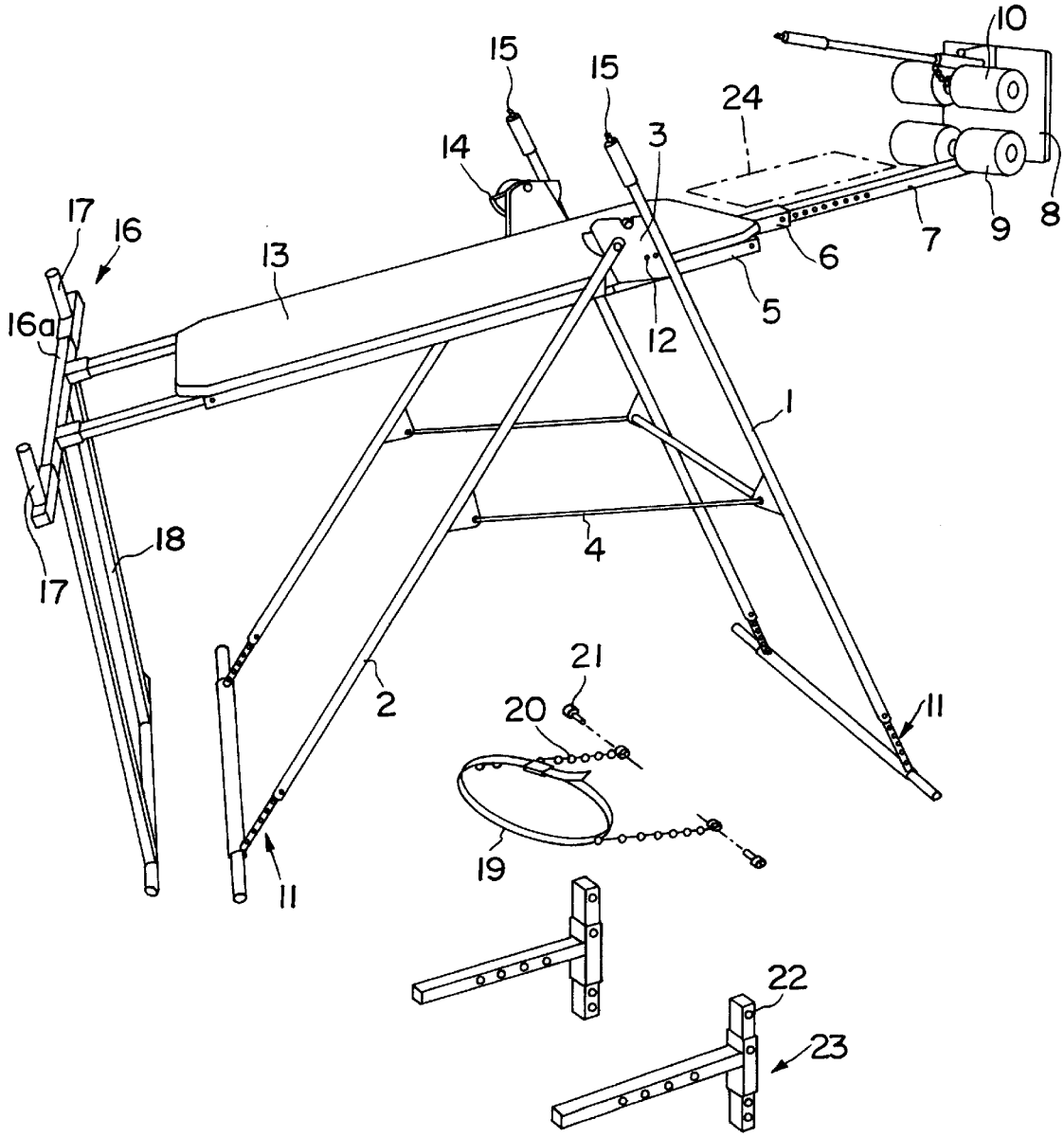
FIG. 2 shows the same perspective view of an alternative embodiment of the device according to the invention.

FIG. 2 shows an alternative embodiment of the device according to the invention in which the frame 5 is provided with a stand 16 protruding in longitudinal direction of the frame 5 at the head end of the body-supporting table 13. The stand 16 includes a bar 16a mounting two handles 17 at opposite ends thereof for arm stretching and which extend at right angles from a plane through the upperside of the body-supporting table 13. An additional support stand 18 extends perpendicularly downwardly from the under side of the bar 16*a*. The handles 17 can be adjusted into different distances in between and into different distances between the handles and the body-supporting table 13. The stand 18 is mounted not until the body-supporting table 13 is in a mainly horizontal position and is adjustable vertically to allow a firm adjustment of the body-supporting table 13 into different inclinations which allows different kinds of treatment such as massage, the stand 8 takes up weight beside the stand portions 1, 2.

In order to hold the waist part of the person who is treated in place, the stand is provided with a lumbar belt 19 which is fixed round the person's waist and which is attached to the stand by means of two chains 20 which are fixed to the stand, e.g., with screws 21 which are screwed into a point of attachment 22 on separate T-shaped brackets 23 which are movable introduced at the foot-end of the frame 5. The brackets 23 with the points of attachment 22 are adjustable both in the longitudinal direction of the frame 5 and perpendicular to the plane through the body supporting table 13 in order to allow a correct adjustment of the lumbar belt 19 corresponding to the body length of the person to be treated. The lumbar belt 19 and the brackets 23 belonging to it are shown separately in FIG. 2.

The stand 16 at the head end of the body-supporting table 13 can also be used to support holders and tractive devices for the stretching of head and neck in which treatment the body-supporting table 13 is mainly horizontally arranged. Those devices are known from previous embodiments.

By means of the telescoping foot sections 11 on each stand portion 1, 2, the stand can be adjusted to vary the inclination of each stand portion 1, 2 to the ground. It has shown favourable to let the foot section 11 of the front stand part 1 be more telescoped than the foot section 11 of the rear stand portion 2. Thus, the footrest 8 on the bar 7 from the frame 5 can be taken very close to the ground (floor) without need for the footrest 8 to telescope in between the legs of the front stand portion 1. By adjusting the portion of, e.g., the front foot section 11, the gradual adjustment of the body-supporting table 13 can get different initial positions for adjustment of the locking device in relation to the ground (floor). Thus, the locking device for gradual adjustment of the body-supporting table into different angles of inclination combined with the vertically adjustable stand portions allows the body-supporting table to be adjusted into different angles of inclination in relation to the ground (floor) in addition to the angles of inclination which are determined by the steps of the locking device. The detachable foot sections 11 also allow the stand to be disassembled and kept in a limited space.

Like the device according to FIG. 1, the device shown in FIG. 2 is covered with a plastic cloth with very low friction towards the body of the person who is treated. The low friction enables the treatment with clock pendulum motion, as it is called, to be carried out with a considerably lesser inclination of the body supporting table as is the case with earlier known devices. From an initial position the body-supporting table 13 inclining 30° in relation to the horizontal plane and the footrest 8 being located above the turning point, the body-supporting table 13 can be pivoted for + or −15°, i.e., between 15° and 45°, and can give considerate stretchings above all to that part of the back which is nearest to the pelvis. The resulting strain on the spine at the pelvis is considerably lower than the strain which arises when the body supporting table is inclined further more or is put in inverted position with the footrest 8 upwards.

It also is possible to provide the frame 5 with leg support 24 of which one is shown dash dotted in FIG. 2 and on which the person's legs can be placed under treatment. Thus, the device together with the stand 18 gets usable as a normal treatment table.

We claim:

1. A therapeutic device for treating physical ailments which comprises:

first and second stand portions which each include first and second spaced leg shanks that extend upwardly from lower ends on a flooring surface to upper ends, and first and second mounting plates which respectively connect upper ends of said first and second leg shanks of said second stand portion with said first and second leg shanks of said first stand portion, the first and second leg shanks of one of said first and second stand portions being pivotably connected to the respective mounting plates and the first and second leg shanks of at least one of said first and second stand portions being extendable in length, a generally rectangular frame which is positioned between said first and second mounting plates and is pivotally connected thereto so as to be pivotable about a horizontal axis, said frame including opposite upper and lower ends and a mounting bracket which extends from said lower end thereof, a body-supporting table covered by a low friction material and having an upper edge and a lower edge mounted on said frame, a footrest assembly which includes a footrest and a bar which extends from the footrest and into said mounting bracket so as to be adjustably positioned in distance relative to said frame, a head stand connected to said upper end of said frame so as to extend in a longitudinal direction of said frame, said head stand including two spaced grip handles, and a support stand connected to the head stand for supporting the head stand above the flooring surface, and said frame being pivotable about said horizontal axis so as to move between a standard position where the frame is generally vertically positioned with said footrest beneath said frame and a treatment position wherein the footrest is above the horizontal axis, the length of said leg shanks of said at least one stand portion being adjustable so that said footrest is positionable on said flooring surface.

2. A therapeutic device according to claim 1, including a lumbar belt at one of the stand, the frame and the body-supporting table.

3. A therapeutic device according to claim 1, wherein said low friction material is PTFE plastic cloth.

4. A therapeutic device according to claim 1, wherein said head stand includes a bar which extends in an imaginary plane defined by said frame, and wherein said grip handles are connected to opposite ends of said bar.

5. A therapeutic device according to claim 4, wherein said grip handles extend perpendicularly to said imaginary plane and wherein said support stand includes two leg elements which extend from said bar to said flooring surface.

* * * * *